United States Patent [19]

Klein

[11] Patent Number: 4,482,788

[45] Date of Patent: Nov. 13, 1984

[54] TRANSDUCER FOR THE TRANSFORMATION OF ELECTRICAL MODULATIONS INTO VIBRATORY MODULATIONS

[76] Inventor: Siegfried Klein, 42 rue de la Tour d'Auvergne, Paris 75009, France

[21] Appl. No.: 312,635

[22] Filed: Oct. 19, 1981

Related U.S. Application Data

[63] Continuation of Ser. No. 132,230, Mar. 31, 1980, abandoned.

[30] Foreign Application Priority Data

Apr. 13, 1979 [FR] France ..... 79 09449

[51] Int. Cl.[3] ..... H04R 23/00

[52] U.S. Cl. ..... 179/113

[58] Field of Search ..... 179/113

[56] References Cited

FOREIGN PATENT DOCUMENTS 1041790 10/1953 France ..... 179/113

303175 1/1930 United Kingdom ..... 179/113

*Primary Examiner*—George G. Stellar

*Attorney, Agent, or Firm*—Michael J. Striker

[57] ABSTRACT

Transducer for the transformation of electrical modulations into vibratory modulations, comprising a needle-shaped discharge electrode, which is embedded, except in the region of its tip, in an electrode holder of substantially cylindrical form, made of an electrically insulating, and heat-resistant material, and a counter-electrode spaced from the discharge electrode and surrounding the latter.

The counter-electrode has substantially the form of a sphere embodied in a perforated, electrically conductive material permeable to sound waves, and has a passage in which electrode holder is fitted. The discharge electrode extends radially into the interior of the spherical counter-electrode up to a point situated in proximity to the center of the sphere.

The transducer thus embodied is omnidirectional.

17 Claims, 3 Drawing Figures

TRANSDUCER FOR THE TRANSFORMATION OF ELECTRICAL MODULATIONS INTO VIBRATORY MODULATIONS

CROSS-REFERENCE TO A RELATED APPLICATION

This application is a continuation of the application Ser. No. 132,230 filed Mar. 31, 1980 now abandoned.

BACKGROUND OF THE INVENTION

The present invention relates to a transducer for the transformation of electrical modulations into vibratory modulations, comprising a needle-shaped discharge electrode which is embedded, except in the region of its tip, in an electrode holder of substantially cylindrical shape made of an electrically insulating and heat-resistant material, and a counter-electrode, spaced from the discharge electrode and surrounding the latter.

A sound emitter or transducer using no vibrating diaphragm is known under the name IONOPHONE, the sound waves being created by a powerful corona discharge, which is modulated by an electrical signal that is to be transformed into sound waves, and causes the ambient air to vibrate. Such an apparatus is described in particular in French Pat. No. 1,041,790 by the Applicant, and the certificates of addition attached thereto.

In all the embodiments known up to this time, the corona-effect emitter is mounted at the input to an exponential horn which directs the sounds in a privileged direction.

SUMMARY OF THE INVENTION

It is the object of the present invention to provide a transducer based on the same principle, in the sense that it likewise uses a powerful corona discharge modulated to cause the ambient air to vibrate, and to create sound waves, but which is omni-directional characteristics.

With this in mind, the transducer according to the present invention is characterized in that the counter-electrode has substantially the form of a sphere embodied of a perforated, electrically conductive material permeable to sound waves, and has a passage in which the said electrode holder is fitted, and in that the discharge electrode extends radially inside the spherical counter-electrode up to a point situated in proximity to the center of the sphere.

According to one embodiment of the present invention, the counter-electrode can be constituted by a fine-mesh metal grid and it can be formed of two hemispherical portions assembled together by crimping at the level of the equator, the said passage being formed at the top of one of the two hemispherical portions.

DESCRIPTION OF THE DRAWINGS

The invention will now be described in detail with reference to the attached drawing in which.

DETAILED DESCRIPTION OF THE PREFERRED EMBODIMENTS

Figure 1:
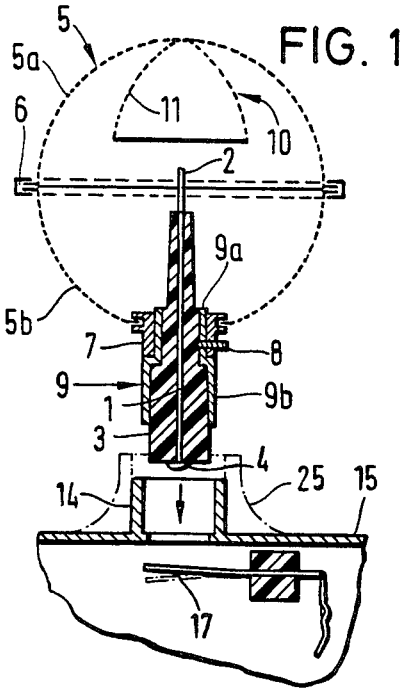
FIG. 1 is a view in section of the transducer according to the present invention.

The transducer represented in FIG. 1 comprises a discharge electrode 1 in the form of a needle, which is embedded, except in the region of its tip 2, in an electrode holder 3, of substantially cylindrical shape, made of a heat-resistant material with a high dielectric constant, for example, of "Teflon". At its end opposite the tip 2, the discharge electrode 1 is terminated by a contact stud 4 which projects from the lower end face of the electrode holder 3.

The discharge electrode 1 is surrounded by a counter-electrode 5 of spherical shape, which is constituted by two hemispherical portions 5*a* and 5*b*, which are assembled together at the level of the equator by means of a crimping ring 6. The two hemispherical portions 5*a* and 5*b* are preferably constituted by a fine-mesh metal grid. The size of the meshes is selected so that the counter-electrode 5 will be permeable to sound waves but forms a Faraday cage impermeable to the electromagnetic waves emitted by discharge electrode 1. As a variation, the two hemispherical portions 5*a* and 5*b* can be constituted by a metal sheet perforated with a plurality of small holes, and suitably shaped.

A ring 7 of conductive metal, for example of copper or brass, is crimped in the wall of hemispherical portion 5*b*, at the top of the latter. Ring 7 forms a passage for electrode-holder 3 which is fitted in ring 7 in such a way that discharge electrode 1 will extend radially into the interior of the spherical counter-electrode 5 to a point situated in proximity to the center of the sphere, but far enough from counter-electrode 5 to avoid the formation of an electric arc. A locking screw 8 makes it possible to lock electrode holder 3 in ring 7.

A conductive sleeve 9, made of copper or brass, for example, surrounds electrode holder 3 in its region which is exterior to the spherical counter-electrode 5. Sleeve 9 has a part 9*a* which has an axial length substantially equal to that of ring 7, and which is engaged in sliding contact in the bore of the latter. Preferably, part 9*a* of sleeve 9 has a smaller diameter than that of the remaining exterior part 9*b* of the sleeve, in order to define a shoulder between parts 9*a* and 9*b* limiting the penetration of electrode holder 3 into the interior of the spherical counter-electrode 5, so that tip 2 will be in proximity to the center of the latter.

As a variation, sleeve 9 can form an integral part of ring 7 and constitute a prolongation of the latter. In this case, electrode holder 3 can have substantially the same form as that represented in FIG. 1, and be engaged slidably in sleeve 9.

Figure 2:
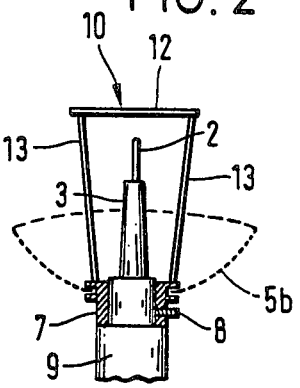
FIG. 2 is a partial view showing a variation of the transducer represented in FIG. 1.

The transducer according to the invention can also have a priming electrode 10 which is disposed in the interior of the spherical counter-electrode 5, and connected electrically to the latter. Since electrode 10 is closer to the tip 2 than counter-electrode 5, the gradient of the HF electrical field between tip 2 and electrode 10 is higher, which facilitates the priming of the corona discharge. As shown in FIG. 1, the priming electrode 10 can be constituted, for example, by a dome 11 of metal grillwork, which is fixed by its top to the top of hemispherical portion 5*a*, and whose concavity is oriented toward the tip 2 of discharge electrode 1. According to a variation of embodiment represented in FIG. 2, the priming electrode 10 can be constituted by a ring 12 of conductive metal, connected to conductive ring 7 by tie-bars 13 of conductive metal. Preferably, ring 12 is situated at a distance of about 15 mm in front of tip 2 and has a diameter of about 30 mm.

Conductive sleeve 9 forms a base which can be fitted with mild friction in a metal socket 14 integral with a metal housing 15 enclosing a circuit (not shown) that generates a high-frequency and high-voltage signal, modulated by the low-frequency signal which is to be transformed into sound waves. The wiring diagram of such an HF generating circuit is described, for example, in the abovementioned French patent of the Applicant. A contact member 17, embodied, for example, in the form of a spring leaf and connected to the output of the abovementioned generating circuit is provided in the interior of housing 15 facing the opening in socket 14. Thus, when in operation, counter-electrode 5 is grounded through ring 7, sleeve 9 and socket 14, while discharge electrode 1 is connected electrically to the output of the said HF generating circuit through contact stud 4 and spring leaf 17.

As a variation, sleeve 9 can be threaded on the outside and socket 14 can be tapped on the inside so that they can be joined together.

It is also possible to provide a junction device of the bayonet type between sleeve 9 and socket 14.

Figure 3:
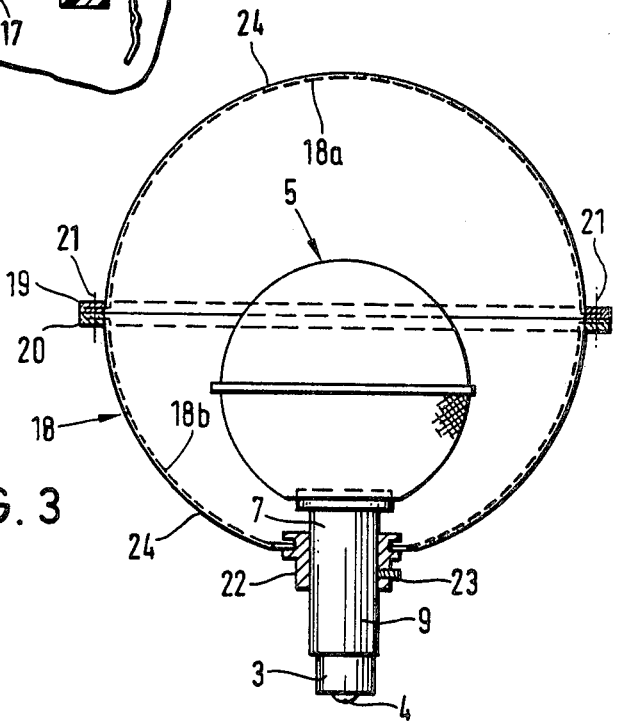
FIG. 3 is a view partly in section and partly in elevation, showing the transducer in FIG. 1, complemented by a protective sphere.

As shown in FIG. 3, the spherical counter-electrode 5 can be completely surrounded by a protective sphere 18 of larger diameter, made of a perforated material permeable to sound waves. Protective sphere 18 can be constituted, for example, by two hemispherical portions 18*a* and 18*b* which are provided, respectively, with annular flanges 19 and 20 allowing them to be assembled at the level of the equator by means of screws 21. A ring 22 of conductive metal is crimped in the wall of hemispherical portion 18*b* at the top of the latter, and forms a passage for sleeve 9 of electrode holder 3. A locking screw 23 permits locking sleeve 9 in ring 22.

The two hemispherical portions 18*a* and 18*b* are preferably embodied of metal grillwork, forming thereby a second Faraday cage around spherical counter-electrode 5, which prevents any leakage of electromagnetic waves to the outside. Protective sphere 18 also makes it possible to avoid any manual contact with the spherical counter-electrode 5 which, when in operation, is relatively hot because of the heat generated by the corona discharge at the tip 2 of the discharge electrode.

Each of the two portions 18*a* and 18*b* of the protective sphere 18 can also be lined with a fabric 24 permeable to sound waves, in such a way as to protect the transducer from dust, and to mask the light emitted by the corona discharge.

Sleeve 9 or socket 14 can be surrounded, as shown in dotted lines in FIG. 1, by a reflector 25 constituted by a body of revolution with exponential meridian, to reflect, in an appropriate direction, the sound waves emitted downward toward the housing 15. As a variation, housing 15 can be covered with a pad of plastic or rubber foam, or of any other sound dampening material.

It is clearly understood that the forms of execution which have been described, and have been given by way of purely indicative and non-limiting example, and that numerous modifications can be imparted without thereby departing from the scope of the present invention.

What is claimed is:

1. A transducer for the transformation of electrical modulations into acoustic vibrations, comprising a needle-shaped discharge electrode having a tip, which is embedded, except in the region of its tip, in an electrode holder made of an electrically insulating and heat-resistant material, and a hollow counter electrode surrounding said discharge electrode and having an interior and being formed of an electrically conductive material, permeable to sound waves, and including a passage in which said electrode holder is fitted and through which the latter extends into said interior, said counter electrode being perforated and being spaced from said tip of said discharge electrode so that the counter electrode forms a Faraday cage.

2. The transducer according to claim 1, wherein said counter electrode is constituted by a fine-mesh metal grid.

3. The transducer according to claim 1, wherein said counter electrode has a substantially spherical shape, said tip extending radially into the interior of said counter electrode up to a point situated in the proximity to the center of the counter electrode.

4. The transducer according to claim 3, wherein said counter electrode is constituted by two hemispherical portions assembled together by crimping at the level of the equator.

5. The transducer according to claim 4, wherein said passage is formed at the top of one of said two hemispherical portions.

6. The transducer according to claim 5, wherein said passage is formed by a first ring of conductive metal, which is crimped in a wall of said spherical counter-electrode.

7. The transducer according to claim 6, wherein said first ring is provided with means for locking said electrode holder in said passage.

8. The transducer according to claim 6, said electrode holder being provided with a conductive sleeve in the region which is exterior to said counter electrode, said sleeve having a part which is engaged in sliding contact in the bore of said first ring of conductive metal.

9. The transducer according to claim 8, wherein said part of said conductive sleeve, which is engaged in said first ring has a diameter smaller than that of the remaining part of said conductive sleeve.

10. The transducer according to claim 9, further comprising a priming electrode which is disposed in the interior of said spherical counter-electrode and is electrically connected to the latter.

11. The transducer according to claim 10, wherein said priming electrode is constituted by a dome of metal grillwork which is fixed by its top to said counter-electrode, said dome having concavity being oriented toward the tip of said discharge electrode.

12. The transducer according to claim 11, wherein said priming electrode is constituted by a second ring of conductive metal connected to said first ring by tie-rods of conductive metal.

13. The transducer according to claim 1, wherein said counter electrode is completely surrounded with a protective housing made of perforated material permeable to sound waves.

14. The transducer according to claim 13, wherein said protective housing is of a shape of sphere of a diameter larger than that of the counter electrode.

15. The transducer according to claim 14, said sphere of said housing being constituted by two hemispherical portions assembled together detachably at the level of the equator, one of said hemispherical portions of said sphere being provided at the top with a passage through which a part of said electrode holder, which is exterior to said counter electrode, can pass.

16. The transducer according to claim 15, wherein said hemispherical portions forming said protective housing are embodied in a metal grillwork, and wherein said passage in said one hemispherical portion is formed by a third ring of conductive metal, which is provided with means for locking said electrode holder.

17. The transducer according to claim 13, wherein said protective housing is lined with a fabric permeable to sound waves.

* * * * *